US006643855B1

(12) United States Patent
Huang

(10) Patent No.: US 6,643,855 B1
(45) Date of Patent: Nov. 11, 2003

(54) DEVICE FOR CONTROLLING THE DISCHARGING AMOUNT OF THE FLUSH WATER FROM A TOILET TANK

(76) Inventor: Jia-Jang Huang, P.O. Box 697, Feng-Yuan City, Taichung Hsien (TW), 420

( * ) Notice: Subject to any disclaimer, the term of this patent is extended or adjusted under 35 U.S.C. 154(b) by 0 days.

(21) Appl. No.: 10/172,019

(22) Filed: Jun. 17, 2002

(51) Int. Cl.[7] ..... E03D 3/12
(52) U.S. Cl. ..... 4/324; 4/325; 4/415
(58) Field of Search ..... 4/324–327, 415

(56) References Cited

U.S. PATENT DOCUMENTS 4,175,296 A * 11/1979 Goldman ..... 4/325
4,447,919 A * 5/1984 Mobilia ..... 4/325
4,530,119 A * 7/1985 Chiu et al. ..... 4/325
4,864,665 A * 9/1989 Toltzman ..... 4/325
4,881,279 A * 11/1989 Harney ..... 4/325
5,375,268 A * 12/1994 Chen ..... 4/325
5,400,445 A * 3/1995 Hull ..... 4/325

* cited by examiner

*Primary Examiner*—Gregory Huson
*Assistant Examiner*—Amanda Flynn

(57) ABSTRACT

A device for controlling the discharging amount of the flush water from toilet tank includes a U-shaped member secured to a lateral wall in the tank and close on two lateral sides by a pair of U-shaped plates, a large rotor, an eccentric wheel and a small rotor disposed into the U-shaped member, a small float ball connected to the eccentric wheel, a trip lever connected to the small rotor, a check plate pivoted to one end of the U-shaped member, a large flush hand connected to a cylindrical body of the large rotor and a small flush handle connected to a positioning rod of the small rotor to be actuated by the large flush handle. When press the large flush handle, a large amount of flush water can be discharged and when press the small flush handle, a small amount of flush water is discharged.

3 Claims, 9 Drawing Sheets

DEVICE FOR CONTROLLING THE DISCHARGING AMOUNT OF THE FLUSH WATER FROM A TOILET TANK

BACKGROUND OF THE INVENTION

The present invention relates to a toilet and more particularly to a device for controlling the discharging amount of the flush water from a toilet tank.

A typical toilet tank 1 (as shown in FIG. 1) contains generally a flush valve 2 for stopping the flush water from discharging out of the tank 1, a water discharging pipe 3 under the valve 2 for discharging the flush water into a bowl, a lift rope 4 connected between the valve and one end of a trip lever 5 which has its other end connected to a flush handle 6 and an inlet tube 7 for entering the water into the tank 1 is controlled by a float ball 8. When the water reaches to a predetermined level, the float ball 8 stops the water from continuously entering into the tank 1 and when a user presses down the flush handle 6 to lift the trip level 5 up to open the valve 2, the water inside tank 1 is discharged out into the bowl. The valve 2 will be automatically closed as the water in the tank is finished. Then the fresh water enters into the tank 1 again through the inlet tube 7 and stops until it reaches to the predetermined level.

For the sake of water saving, a two-step water discharging tank is available in the market. A small step is flushing the urine in the bowl and a large step is flushing the excrement in the bowl. However, people used to use the small step to flush the urine and the excrement at first. If it does not succeed, then use the large step to discharge more flush water into the bowl. This causes waste of water. Therefore, this two-step flushing design could not obtain the purpose of water saving.

SUMMARY OF THE PRESENT INVENTION

The present invention has a main object to provide a device for controlling the discharging amount of the flush water from a toilet tank by which people can freely discharge a large or small amount of flush water into the bowl in order to flush out all the dregs in the bowl. Alternatively, it can be adjusted into a two-step flushing type to achieve variable flushing modes and water saving objective.

The present invention will become more fully understood by reference to the following detailed description thereof when read in conjunction with the attached drawings.

DETAILED DESCRIPTION OF THE PREFERRED EMBODIMENT

Figure 4:
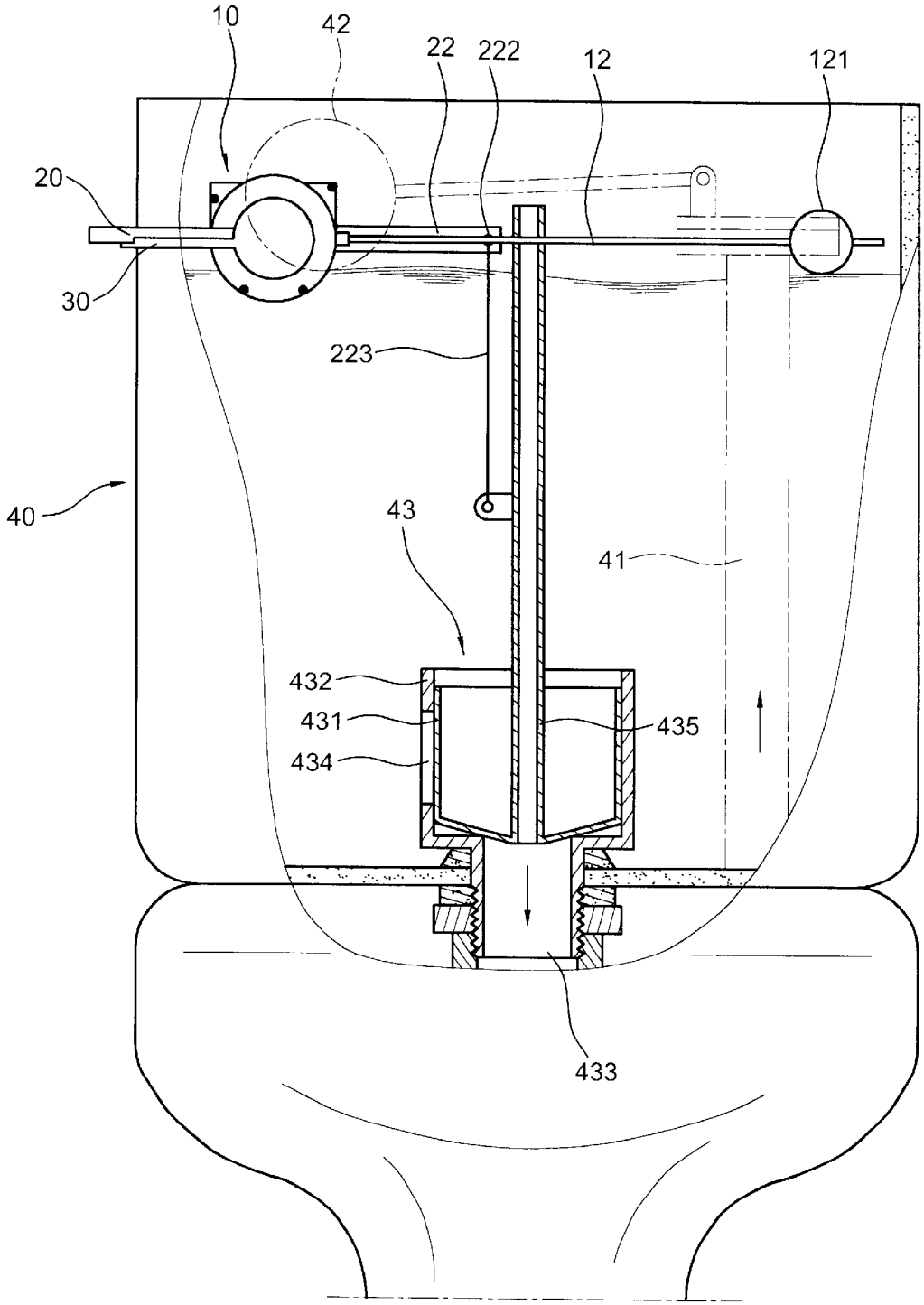
FIG. 4 is a sectional view to show the discharging valve of the present invention.

The device for controlling the discharging amount of the flush water from a toilet tank of the present invention is used incorporation with the original devices in a toilet tank 40 such as the inlet tube 41, the float ball 42 and the discharging valve 43 of the present invention which includes a tubular tank ball 431 a tubular valve seat 432, a water outlet 433, a peripheral passage 434 and a vertical bar 435 centrally connected the tank ball 431 (as shown in FIG. 4).

Figure 1:
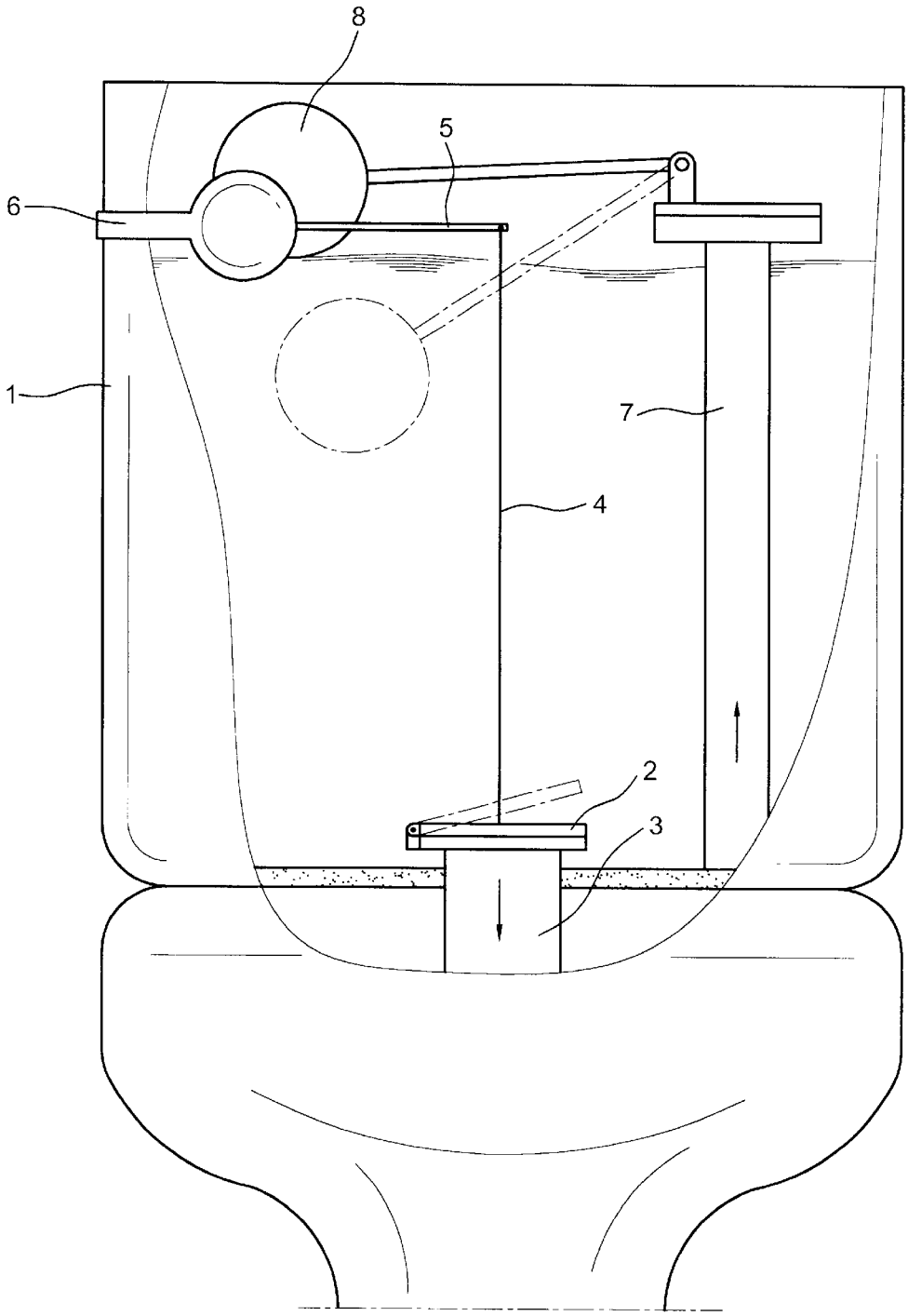
FIG.1 Prior Art
FIG. 1 is a plane view to show the flush devices inside a toilet tank according to a prior art.
Figure 2:
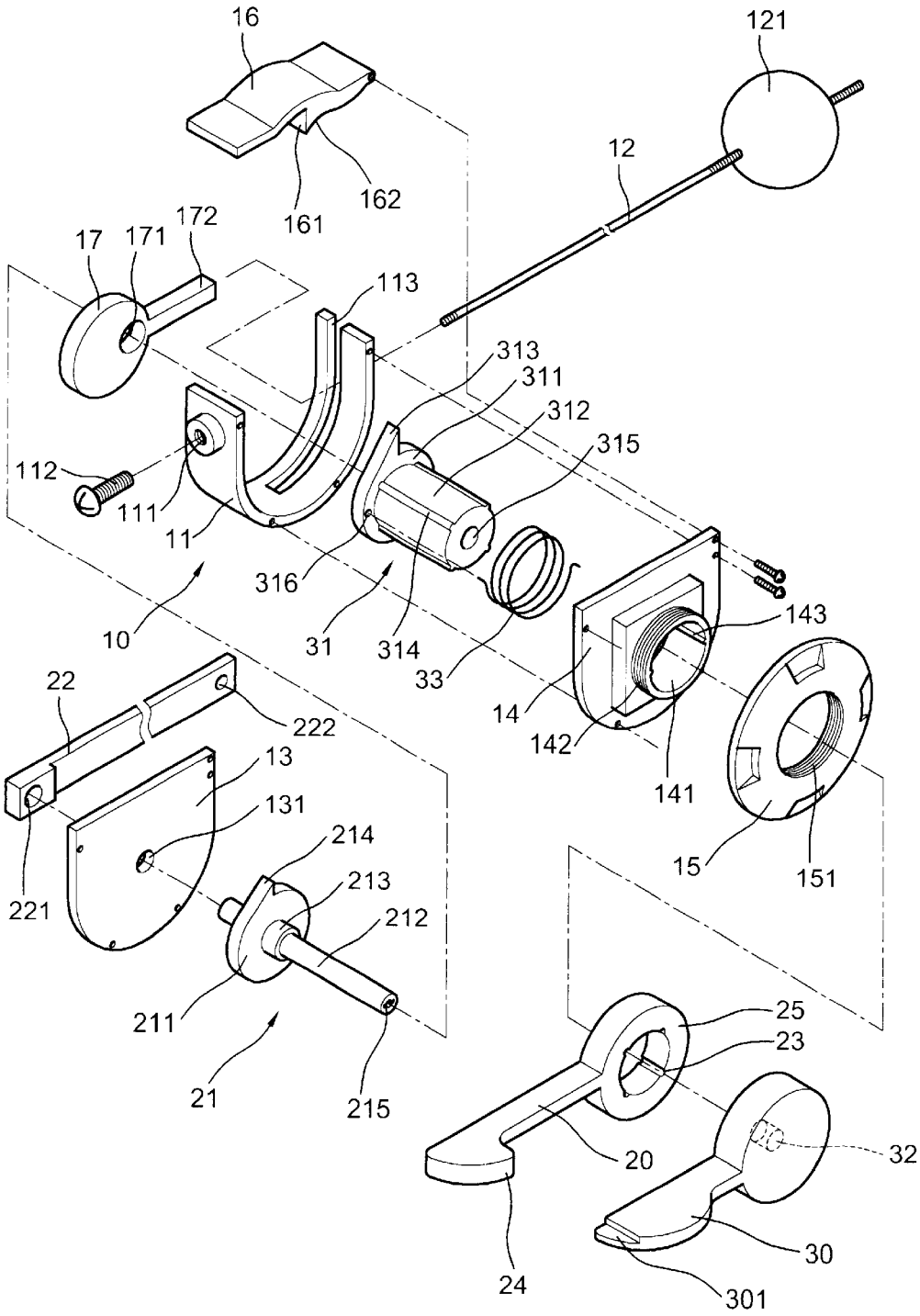
FIG. 2 is an exploded perspective view to show a water saving device of the preferred embodiment according to the present invention.
Figure 3:
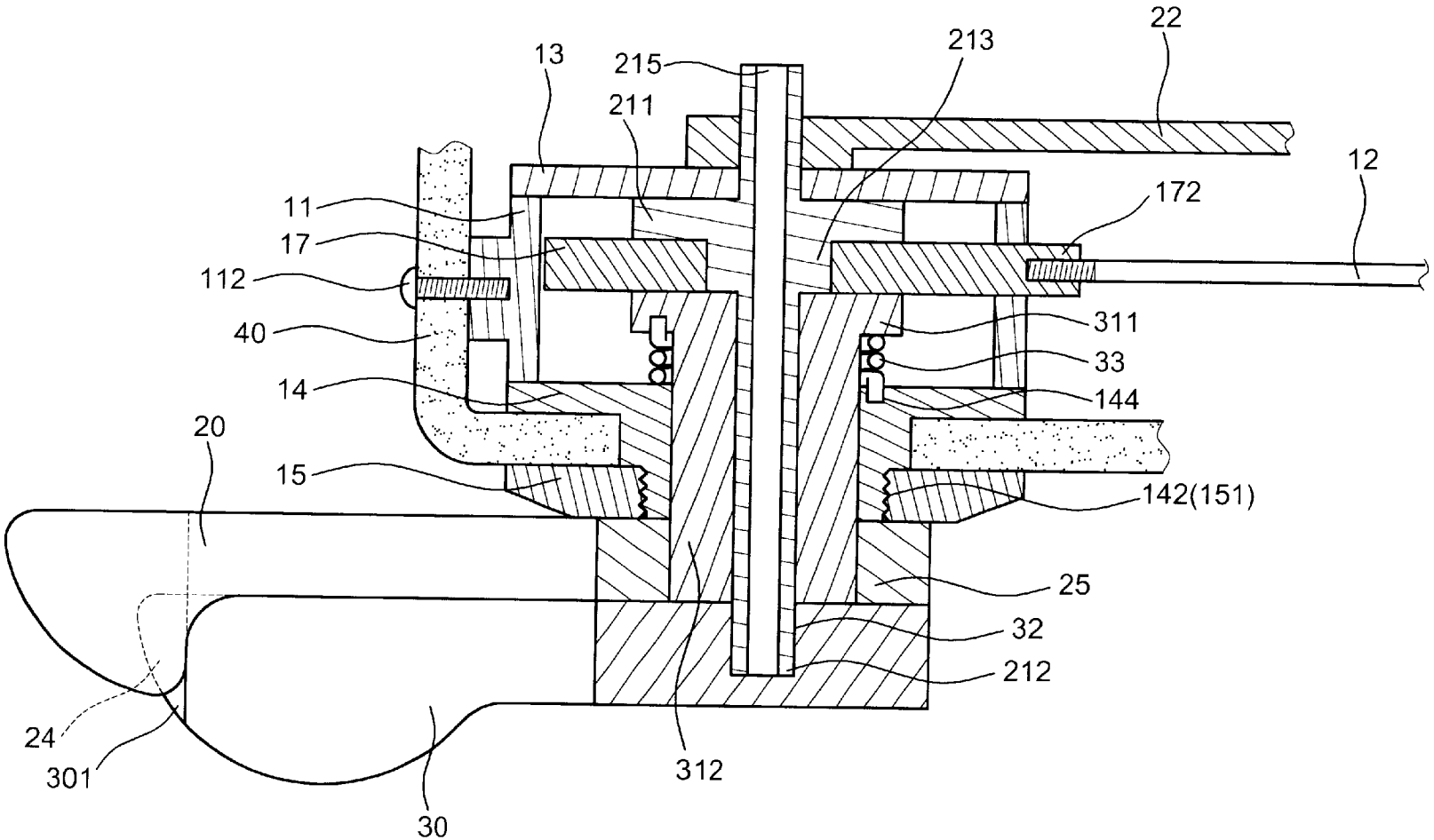
FIG. 3 is a top sectional view to show the assembly of the preferred embodiment of the present invention.

Referring to FIGS. 2 and 3 of the drawings, the device or manely water saving device comprises a seat 10, a large flush handle 20, and a small flush handle 30.

Figure 5:
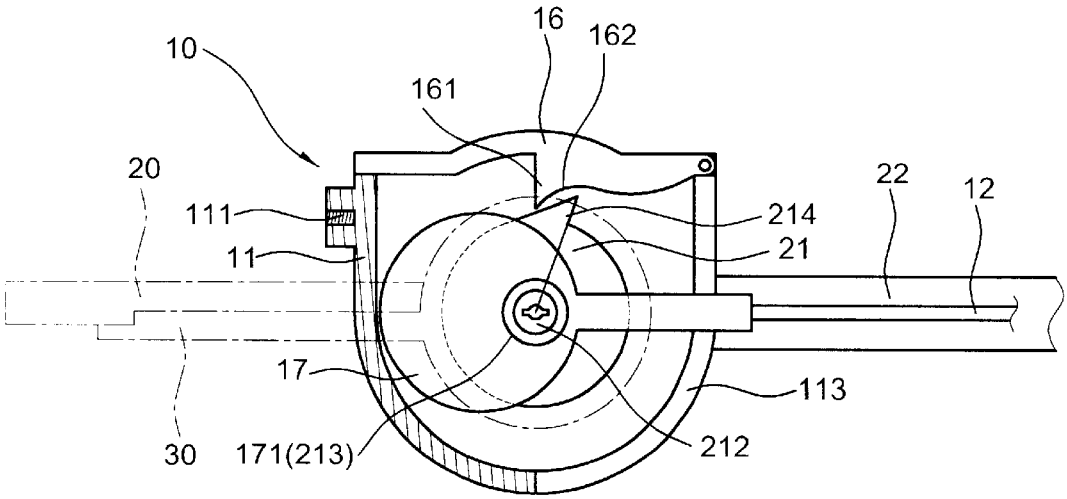
FIG. 5 is a plane view to show the position of a small rotor while the water is full in the tank.
Figure 6:
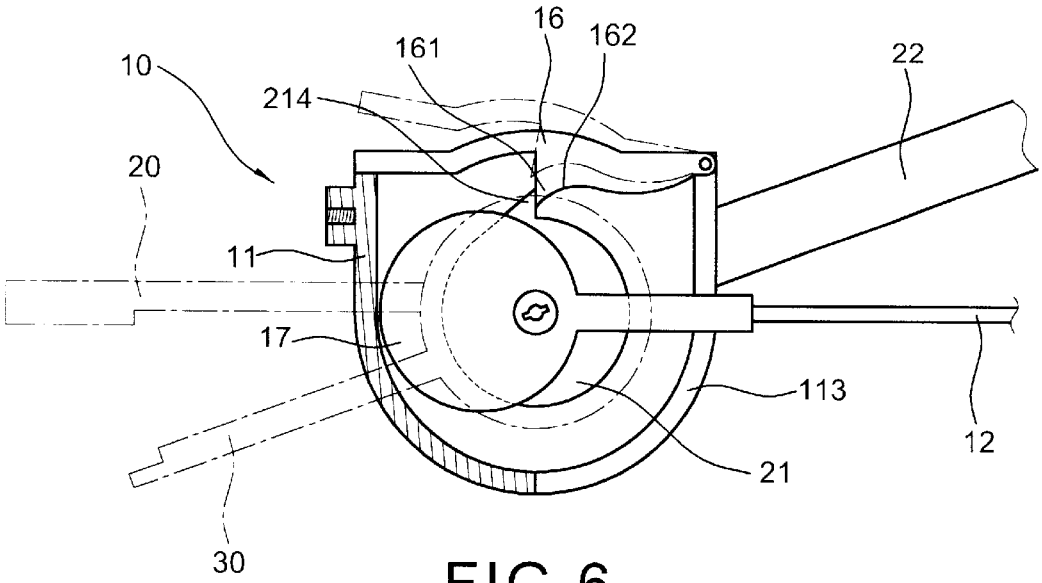
FIG. 6 is a plane view to show the state while the small flush handle is pressed downward.
Figure 12:
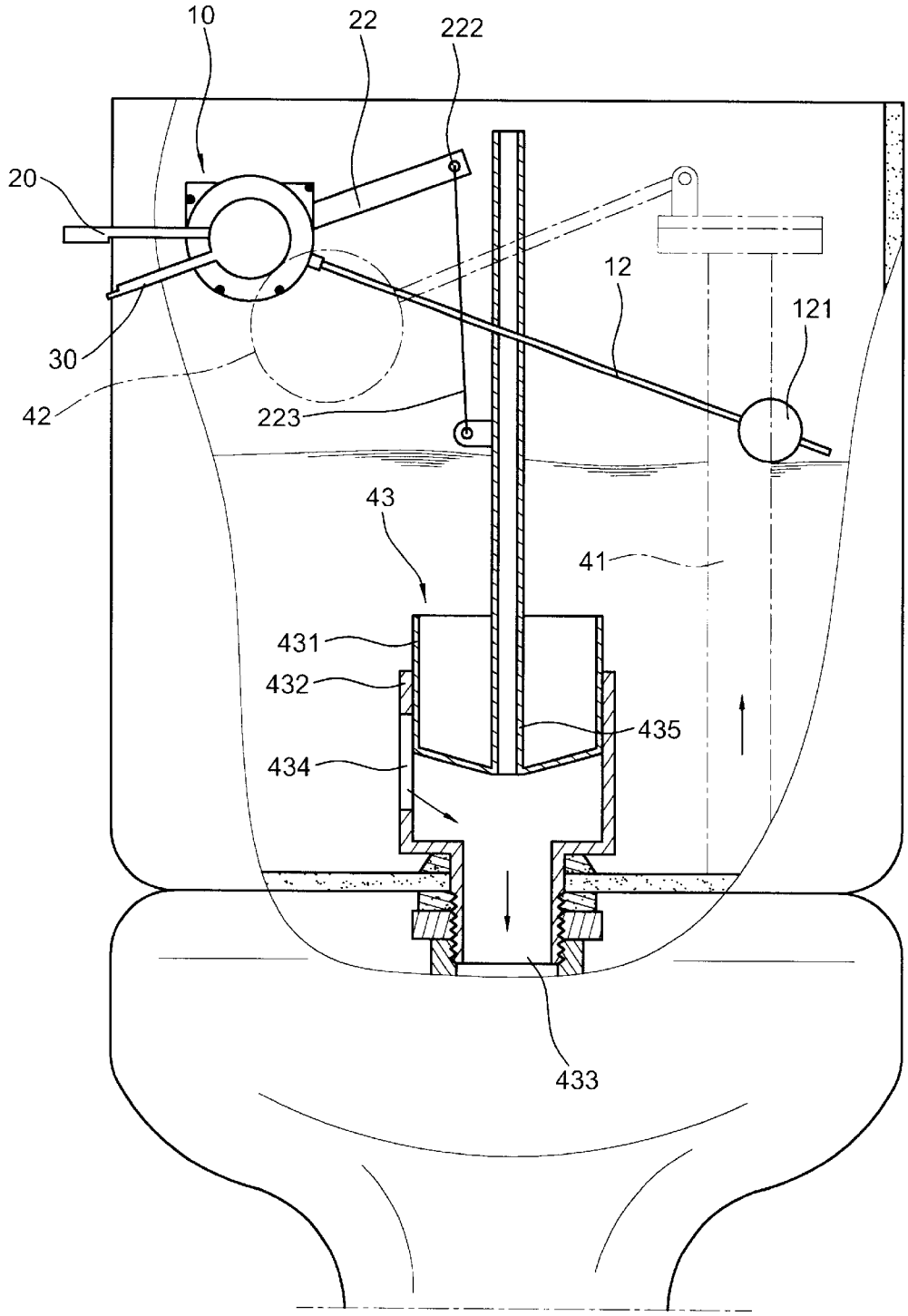
FIG. 12 is a sectional view to show that the tubular tank ball is lifted up and the flush water is discharging out of the tank.

The seat has a U-shaped member 11 having a protrudent screw hole 111 on one end secured to an upper lateral wall of the toilet tank 40 by a bolt 112 and an elongate slot 113 in the other end, a first U-shaped plate 13 secured to a lateral side of the U-shaped member 11 including a central bore 131, a second U-shaped plate 14 secured to other lateral side of the U-shaped member 11 including a protrudent central bore 141, outer threads 142 on the outer periphery of the protrudent central bore 141 and a plurality of splines 143 on the inner periphery of the protrudent central bore 141, a circular plate 15 screwed on the protrudent central bore 141 of the second U-shaped plate 14 and positioned at the outside of the tank 40 including inner threads 151 in a central bore engaged with the outer threads 142 of the second U-shaped plate 14. A small rotor 21 is disposed into the U-shaped member 11 including a circular body 211, an annular ring 213 abutting one side of the circular body 211, a positioning rod 212 inserted through a central bore of the circular body 211 and the annular ring 213 having a central hole 215 in the center thereof and a small protrudent angle 214 on an outer periphery of the circular body 211. An eccentric wheel 17 having an eccentric hole 171 is engaged on the annular ring 213 of the small rotor 21 and a rectangular bar 172 is slidably engaged within the elongate slot 113 projected outward from a periphery near the eccentric hole 171 for connecting one end of an elongate rod 12 which has is other end engaged with a small float ball 121. A large rotor is disposed into the U-shaped member 11 having a circular flange 311 engaged with the eccentric wheel 17, a cylindrical body 312 is extruded from the central bores 141 of the second U-shaped plate 14 and the central bore of circular plate 15, a large protrudent angle 313 on an outer periphery of the flange 311, a plurality of splines 314 on the outer periphery of the cylindrical body 312 engageable with the splines 143 of the second U-shaped plate 14, a central bore 315 engaged with a longer end of the positioning rod 212 and a thru hole 316 in the flange 311, a spring 33 is wrapped on the cylindrical body 312 having one end engaged into the thru hole 316 of the large rotor 31 and an other end engaged into a thru hole 144 in an inner side of the second U-shaped plate 14, a check plate 16 having one end pivoted to an upper portion of the second U-shaped plate 14 by a screw including a check surface 161 and a depressed surface 162 on the underside, the other end thereof stopped on a top of the U-shaped member 11 (as shown in FIG. 5). The longer end of the positioning rod 212 of the small rotor 21 is extruded out from the central bore 315 of the cylindrical body 312 of the large rotor 31 and a short end thereof is extruded out from the central bore 131 of the first U-shaped plate 13 and secured to a thru hole 221 in one end of a trip lever 22 which has a thru hole 222 in the other end for connecting the vertical bar 435 of the tubular tank ball 431 through a rope 223. The large flush handle 20 has an annular ring 25 engaged on the outer end of the cylindrical body 312 of the large rotor 31, a plurality of axial grooves 23 engaged with the splines 314 of the cylindrical body 312 and an enlarge free end 24 (as shown in FIG. 12). The small flush handle 30 is positioned outside of the large flush handle 20 and has a circular cavity 32 engaged with the longer end of the positioning rod 212 of the small rotor 21 and a stepped end 301 engageable with the underside of the enlarge free end 24 of the large flush handle 20.

Figure 7:
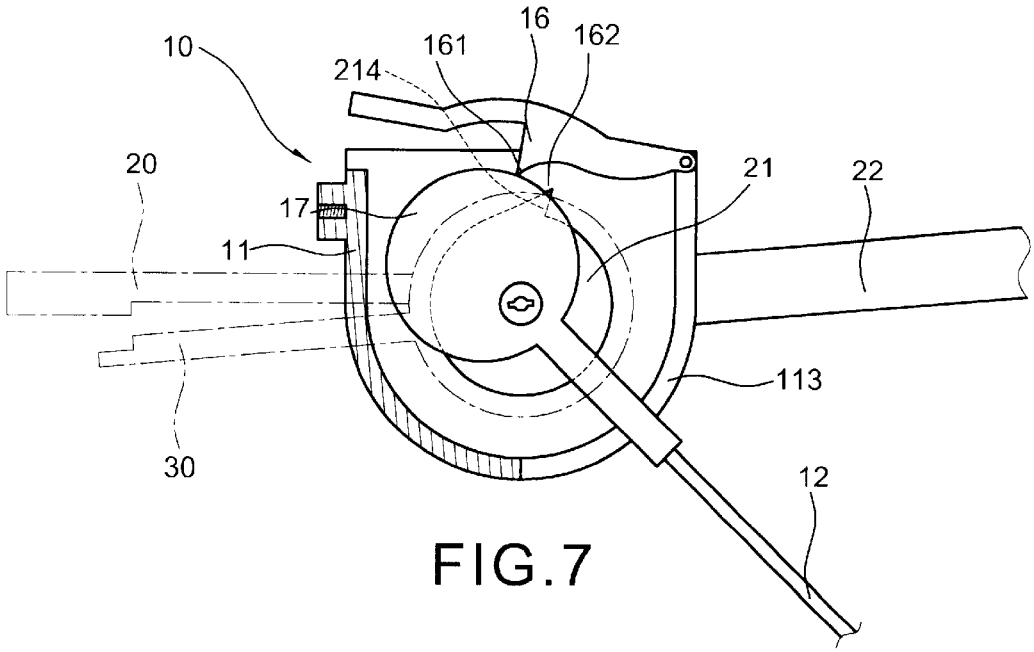
FIG. 7 is a plane view to show that a check plate is pushed up by an eccentric wheel.

Referring to FIGS. 4, 5, 6 and 12, when discharging a small amount of the flush water into the bowl, press the small flush handle 30 downward to actuate the small rotor 21 rotating a certain angle and the free end of the trip lever 22 is raising up a certain angle also to lift the tank ball 431 up to permit the flush water discharging out through the peripheral passage 434 of the valve seat 432 and the water outlet 433 into the bowl. Simultaneously, the check plate 16 is pushed up by the small protrudent angle 214 of the small rotor 21. When the water level in the tank 40 drops down a little, the small rotor 21 rotates again to have the small protrudent angle 214 temporarily stopped against the check surface 161 of the check plate 16. The flush water in the tank 40 continuously drops own until the small float ball 121 drops to a predetermined position (as shown in FIG. 7), the eccentric wheel 17 will push the check plate 16 up again to release the small protrudent angle 214 of the small rotor 21 from against the check surface 161 and returns to its original position. The trip lever 22 is therefore back to its original position. The tank ball 431 drops down to close the passage 434 to stop the discharging of the flush water. In the sametime, the inlet pipe 41 begins to replenish the fresh water into the tank 40. When the water in the tank 40 reaches to the predetermined high level, the eccentric wheel actuated by the small float ball 121 turns back to its original position and the check plate 16 also drops down to its original position (as shown in FIG. 5). The discharging of small amount of the flush water is thus accomplished.

Figure 8:
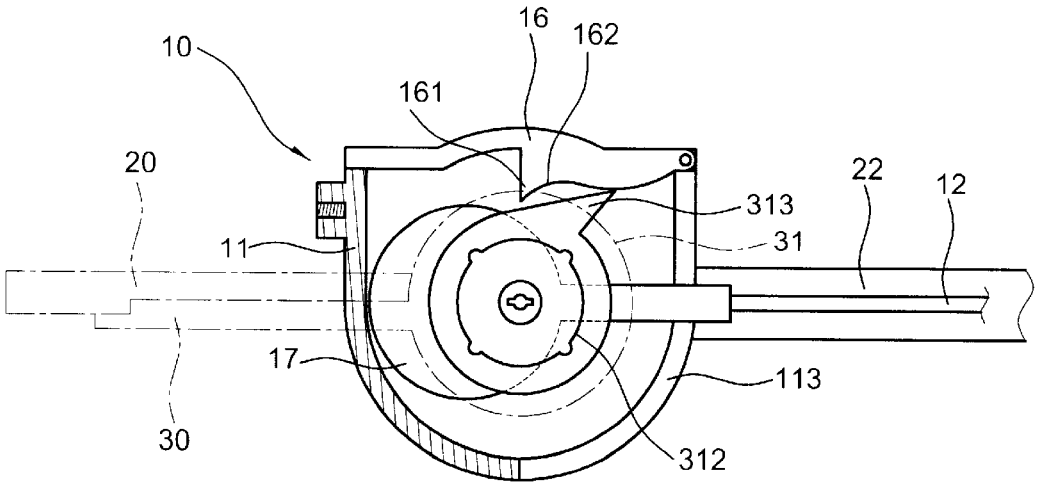
FIG. 8 is a plane view to show the position of a large rotor while the water in the tank is full.
Figure 9:
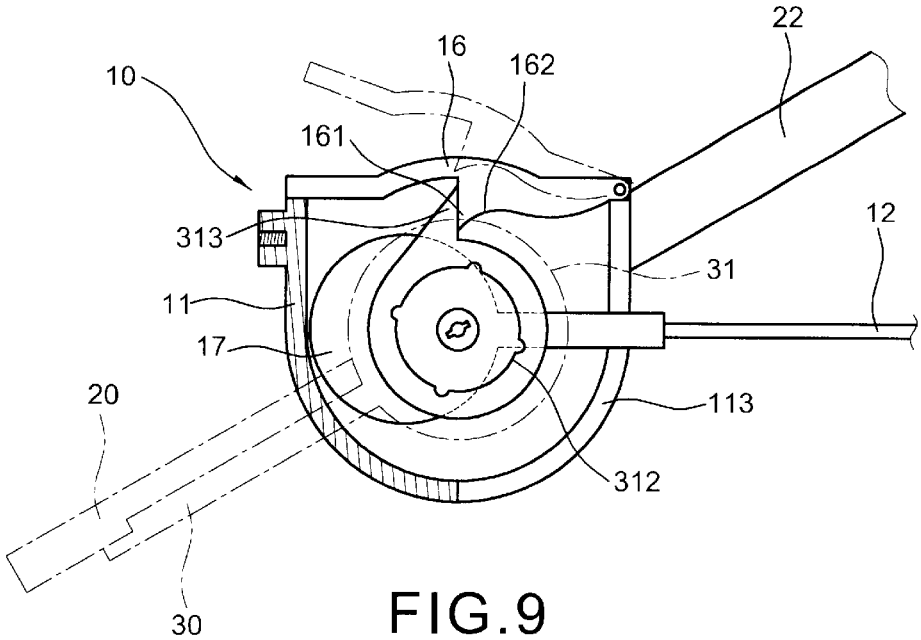
FIG. 9 is a plane view to show the state while the large flush handle is pressed downward.
Figure 10:
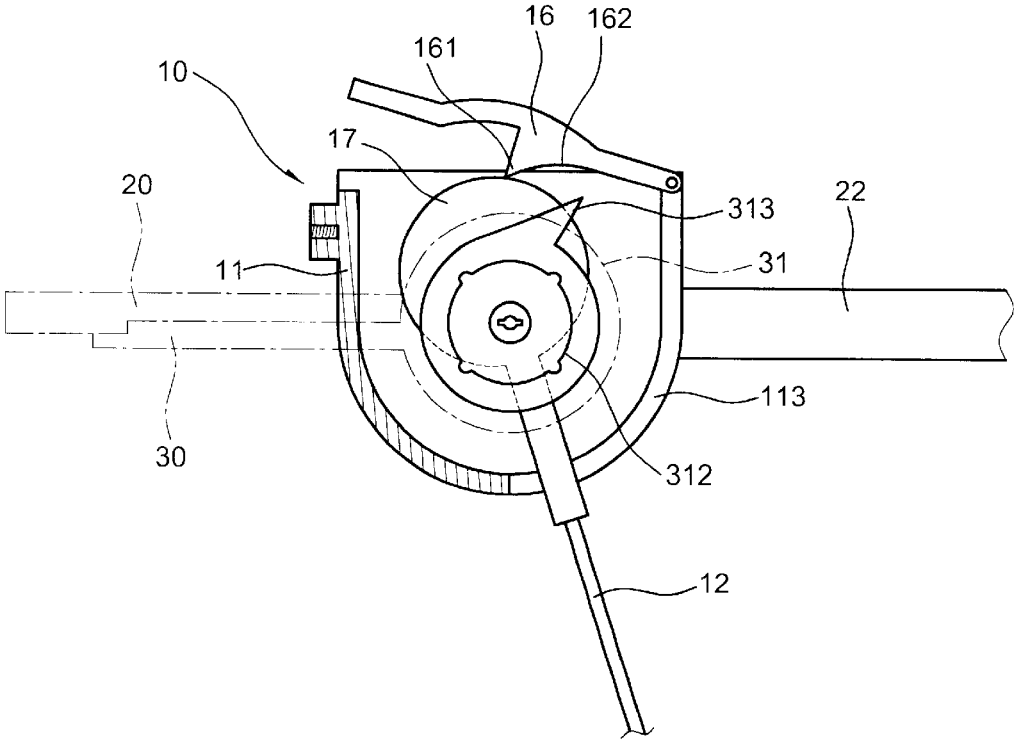
FIG. 10 is a plane view to show another state while the check plate is pushed up by the eccentric wheel.

Referring to FIGS. 3, 4, 8 and 9 of the drawings, when pressing the large flush handle 20 down, the enlarged free end 24 of the large flush handle 20 actuates the small flush handle 30 simultaneously moving downward so that both the large rotor 31 and small rotor 21 rotate a certain angle (the rotation angle of the rotors 31 and 21 is limited by the splines 314 of the cylindrical body 312 and the splines 143 of the second U-shaped plate 14). The trip lever 22 lifts the tank ball 431 up and begins to discharge the flush water. Because of the resilience of the spring 33, the large rotor 31 further rotates an angle to have the large protrudent angle 313 stopped against the check surface 161 of the check plate 16 and because of that the large protrudent angle is relatively high (as shown in FIG. 10), the water in the tank 40 must be dropped to a certain low level (almostly reaching to the bottom of the tank 40) to permit the small float ball 121 to drop to the lowermost position that enables the eccentric wheel 17 to push up the check plate 16 in order to release the large protrudent angle 313 from against the check surface 161 of the check plate 16 and to turn back to its original position. Meantime, the trip lever 22 together with the tank ball 431 drop to their original positions either. Since the passage 433 in closed, the inlet tube 41 begins to replenish the fresh water into the tank 40 until the water level raised to the predetermined position. The eccentric wheel 17 then returns to its original position and no longer to push the check plate 16 (as shown in FIG. 8). Therefore, the large amount discharging of the flush water is thus accomplished.

If one wants to perform a non-step or namely free discharging of the flush water, remove the small float ball 121 or turn over the check plate 16. Both the eccentric wheel 17, the large protrudent angle 313 and the small protrudent angle 214 become useless. This time, the user may continuously press the large flush handle 20 or the small flush handle 30, the tank ball 431 is lifted by the trip lever to discharge the flush water continuously out of the tank 40 until that the user releases the large flush handle 20 and/or the small flush handle 30, the tank ball 431 will drop down on its own weight to close the passage 434 to stop the flush water from further discharging. The small float ball 121 can be displaced on the elongate rod 12 in order to adjust the discharging volume of the flush water from the tank 40.

Figure 11:
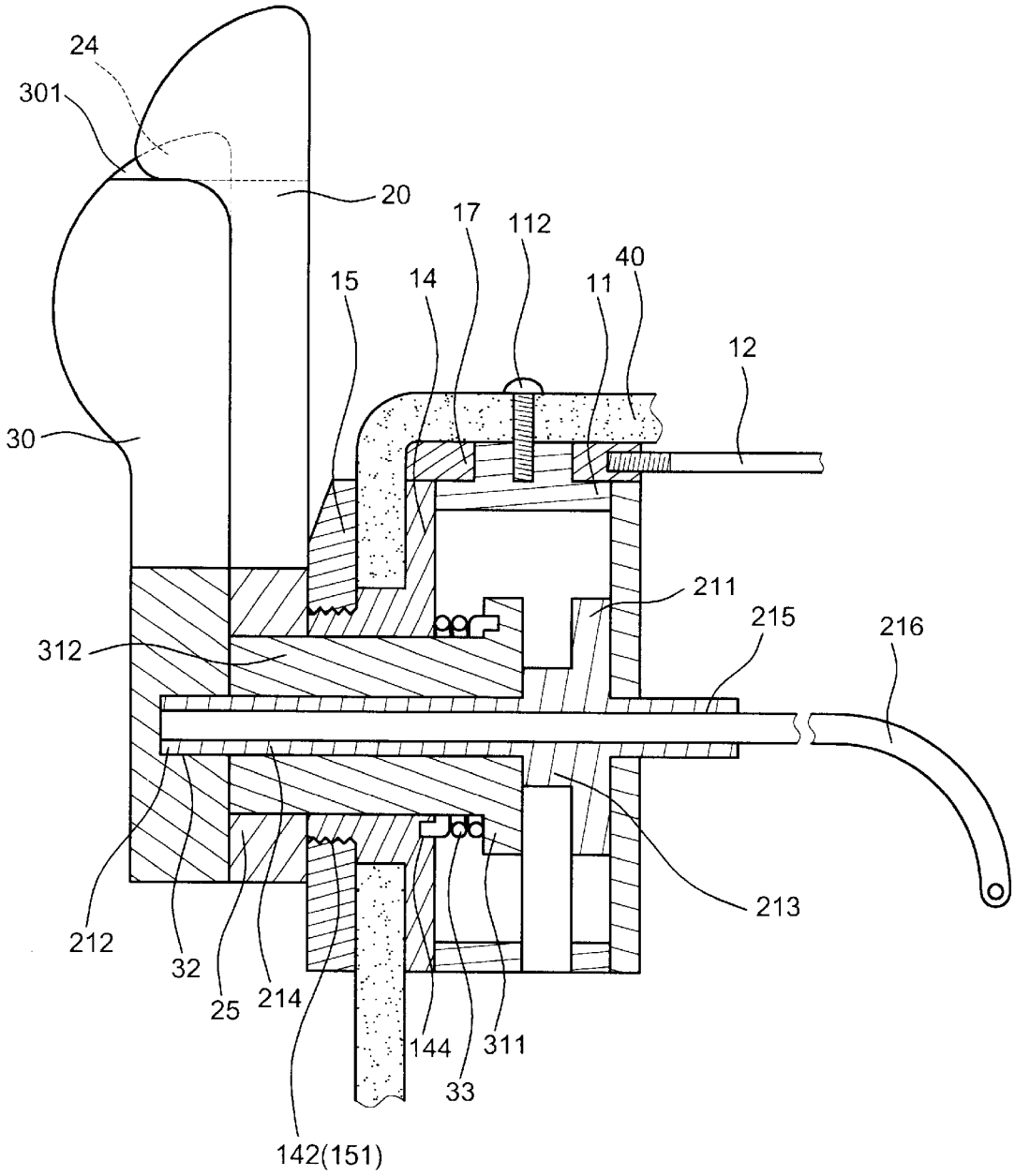
FIG. 11 is a sectional view to show that the flush handles are positioned at a lateral side of the toilet tank.

Nowadays, the flush handle is usually disposed to a front side of the toilet tank 40 or sometimes to the lateral wall of the tank 40. The flush handles of the present invention are disposed to the front side of the tank 40. If changing them to the lateral wall of the tank, a little adjustment must be made (as shown in FIG. 11). A user must insert a trip lever 216 into the central bore 215 of the positioning rod 212 of the small rotor 21. The front portion of the trip lever 216 is arcuate in order to connect the tank ball 431 through the rope 223. Meanwhile, move the eccentric wheel 17 to a lateral side of the U-shaped member and the elongate rod 12 connects to the eccentric wheel 17. The flush handles are therefore moved to the lateral wall of the toilet tank 40.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A device for controlling the discharging amount of flush water from a toilet tank comprising:

a U-shaped member having a protrudent screw hole in one end for securing said U-shaped member to an upper lateral wall of said toilet tank by a bolt, with an elongate slot in other end thereof;

a first U-shaped plate secured to one of the lateral sides of said U-shaped member having a first central bore;

a second U-shaped plate secured to the other lateral side of said U-shaped member having a protrudent central bore, outer threads on outer periphery of said protrudent central bore and a plurality of first splines on the inner periphery of said protrudent central bore;

a circular plate secured to said protrudent central bore of said second U-shaped plate and positioned at the outside of said toilet tank having a second central bore including inner threads on the inner periphery of said second central bore engaged with the outer threads on the protrudent central bore of said second U-shaped plate;

a large rotor disposed into said U-shaped member having a circular flange engaged with the inner surface of said second U-shaped plate, a cylindrical body extruded from said protrudent central bore of said second U-shaped plate, a plurality of second splines on the outer periphery of said cylindrical body engageable with the first splines of said second U-shaped plate, a third central bore, a large protrudent angle on an outer periphery of said circular flange and a first thru hole in said circular flange;

a spring wrapped on the cylindrical body of said large rotor having one end engaged into the first thru hole of said large rotor and other end engaged into a second thru hole in an inner side of side second U-shaped plate;

an eccentric wheel disposed into said U-shaped member abutting said large rotor and having an eccentric hole and a rectangular bar slidable within the elongate slot of said U-shaped member projected outward from a periphery near said eccentric hole;

an elongate rod having one end connected to the rectangular bar of said eccentric wheel and other end engaged with a small float ball;

a small rotor disposed into said U-shaped member abutting said eccentric wheel and said first U-shaped plate having a circular body, an annular ring abutting one side of said circular body engaged within the eccentric hole of said eccentric wheel, a small protrudent angle on an outer periphery of said circular body and a positioning rod secured perpendicularly through said annular ring and a third central bore of said circular body, said positioning rod having a fourth thru hole, a short portion inserted through the first central bore of said first U-shaped plate and connected to a fifth thru hole in one end of a trip lever which has a sixth thru hole in the other end, and a long portion inserted through the second thru hole of said large rotor and extruded from said second thru hole;

a check plate having one end pivoted to one end of said U-shaped member by screw and an other end stopped on other end of said U-shaped member, a check surface and a depressed surface on underside;

a large flush handle having an annular ring on one end is wrapped to the cylindrical body of said large rotor, a plurality of spaced axial grooves formed in the inner peripheral wall of the annular ring engaged with the first splines of said cylindrical body and an enlarged portion on the other end;

a small flush handle with a circular cavity at one end connected to the free end of the long portion of the positioning rod of said small rotor and a stepped portion at the other end thereof engaged with the enlarged portion of said large flush handle;

whereby pressing said large flush handle discharges a large amount of the flush water and pressing the small flush handle discharges a small amount of the flush water from said tank to a bowl.

2. The device as recited in claim 1 wherein said toilet tank further has an inlet tube controlled by a float ball and a discharging valve which includes a tubular valve seat, a water outlet, a peripheral passage and a tubular tank ball slidably disposed in the valve seat and a vertical bar in center of the tank ball suspended from the sixth thru hole of said trip lever by a rope.

3. The device as recited in claim 1 wherein said flush handles can be moved to a lateral wall of said toilet tank by replacing the trip lever with a fore end arcuate cylinder strip lever inserted into the fourth central bore of the positioning rod of said small rotor to connect the tank ball through the rope, moving the eccentric wheel to a lateral side of said U-shaped member and the elongate rod connecting the eccentric wheel.

* * * * *